United States Patent [19]

Regalbuto et al.

[11] Patent Number: 4,739,707

[45] Date of Patent: Apr. 26, 1988

[54] SHAPED CHARGE CARRIER ASSEMBLY

[75] Inventors: John A. Regalbuto, Fort Worth; Philip W. Mayes, Denton, both of Tex.; William C. Behling, Duncan, Okla.

[73] Assignees: Jet Research Center, Inc., Arlington, Tex.; Halliburton Company, Duncan, Okla.

[21] Appl. No.: 895,617

[22] Filed: Aug. 11, 1986

Related U.S. Application Data

[62] Division of Ser. No. 651,201, Sep. 17, 1984, Pat. No. 4,655,138.

[51] Int. Cl.[4] ..... F42B 1/02; F42D 3/00

[52] U.S. Cl. ..... 102/307; 102/310; 102/312; 102/313; 102/321; 175/4.6

[58] Field of Search ..... 102/306, 307, 310, 312, 102/313; 175/4.6

[56] References Cited

U.S. PATENT DOCUMENTS

| | | | |
|---|---|---|---|
| 3,121,389 | 2/1964 | Delacour | 102/306 |
| 3,177,808 | 4/1965 | Owen | 102/310 |
| 3,259,064 | 7/1966 | Owens | 102/306 |
| 3,282,213 | 11/1966 | Bell et al. | 102/310 |
| 4,326,462 | 4/1982 | Garcia et al. | 102/310 |
| 4,598,775 | 7/1986 | Vann et al. | 102/310 X |
| 4,609,057 | 9/1986 | Walker et al. | 102/310 X |
| 4,655,138 | 4/1987 | Regalbuto et al. | 102/307 |
| 4,681,037 | 7/1987 | Regalbuto | 102/310 |

*Primary Examiner*—Peter A. Nelson
*Attorney, Agent, or Firm*—James R. Duzan

[57] ABSTRACT

A shaped charge carrier assembly is provided for use in a perforating gun of the type used to perforate oil or gas wells. The assembly includes at least one shaped charge including an outer case having an outer surface and a first shoulder extending radially outward from the outer surface. The assembly also includes a carrier having an opening therethrough large enough to receive the outer surface of the case, and having a resilient tab extending into the opening for frictionally engaging at least a first portion of the outer surface of the case, and for thereby holding the shaped charge in place relative to the carrier with the shoulder of the shaped charge abutting the carrier.

17 Claims, 4 Drawing Sheets

SHAPED CHARGE CARRIER ASSEMBLY

This application is a division of application Ser. No. 651,201, filed Sept. 17, 1984, now U.S. Pat. No. 4,655,138.

BACKGROUND OF THE INVENTION

1. Field of the Invention

The invention relates to an assembly of a carrier and a shaped charge for use in an elongated perforating gun of the type generally used to perforate oil and gas wells. The invention particularly pertains to the manner in which the shaped charge is held in place relative to the carrier of the perforating gun.

2. Description Of The Prior Art

Perforating guns commonly used in wireline service operations for perforating an oil or gas well typically include an elongated cylindrical outer housing within which is received an elongated carrier which has a number of shaped charges in place in the carrier. The carrier is located relative to the housing so as to locate each of the shaped charges adjacent reduced thickness portions of the housing.

It is known in the prior art to utilize either triangular or hexagonal cross-section tubular carriers constructed to receive three 120° circumferentially spaced shaped charges in a given horizontal plane. When a hexagonal carrier is utilized, longitudinally adjacent layers of charges may be rotated 60° relative to each other to spread out the pattern of perforations along the length of well which is to be perforated.

Typically, the shaped charges have been held in place relative to the carrier by snap rings which interlock both with the outer case of the shaped charge and with the carrier.

Furthermore, a number of structures for attachment of shaped charges to the carrier have been developed.

For example, in U.S. Pat. No. 4,326,462 to Garcia et al., a plastic retaining chip fits over a shoulder of the outer case of the shaped charge. The plastic retaining clip includes flexible arms which snap into holes in the wall of the carrier.

Another arrangement is shown in U.S. Pat. No. 3,773,119 to Shore wherein a square cross-section flexible carrier tube has cut-out portions thereof which engage notches in the outer case of the shaped charge. Additionally, a threaded plug, received in the housing of the perforating gun, itself engages the shaped charge to snugly hold it in place within the housing.

Another example of a manner in which a shaped charge may be retained in place relative to a carrier is shown in U.S. Pat. No. 3,636,875 to Dodson wherein the shaped charge has spaced shoulders between which is received a wire-type frame member.

From these various examples just discussed, it is seen that the prior art has long recognized the need for a reliable means for retaining shaped charges in place within a carrier of a perforating gun. The present invention provides a much improved, very economical, reliable, and easily assembled construction for the assembly of a shaped charge with a carrier.

SUMMARY OF THE INVENTION

The present invention provides a shaped charge carrier assembly for use in a perforating gun. The assembly includes at least one shaped charge having an outer case which itself includes an outer surface and a first shoulder extending radially outward from the outer surface. The assembly further includes a carrier having an opening therethrough large enough to receive the outer surface of the case of the shaped charge. The carrier includes resilient tab means extending into the opening thereof for frictionally engaging at least a first portion of the outer surface of the case of the shaped charge, and for thereby holding the shaped charge in place relative to the carrier with the shoulder of the shaped charge abutting the carrier.

Numerous objects, features and advantages of the present invention will be readily apparent to those skilled in the art upon a reading of the following disclosure when taken in conjunction with the accompanying drawings.

DETAILED DESCRIPTION OF THE INVENTION

Figure 1:
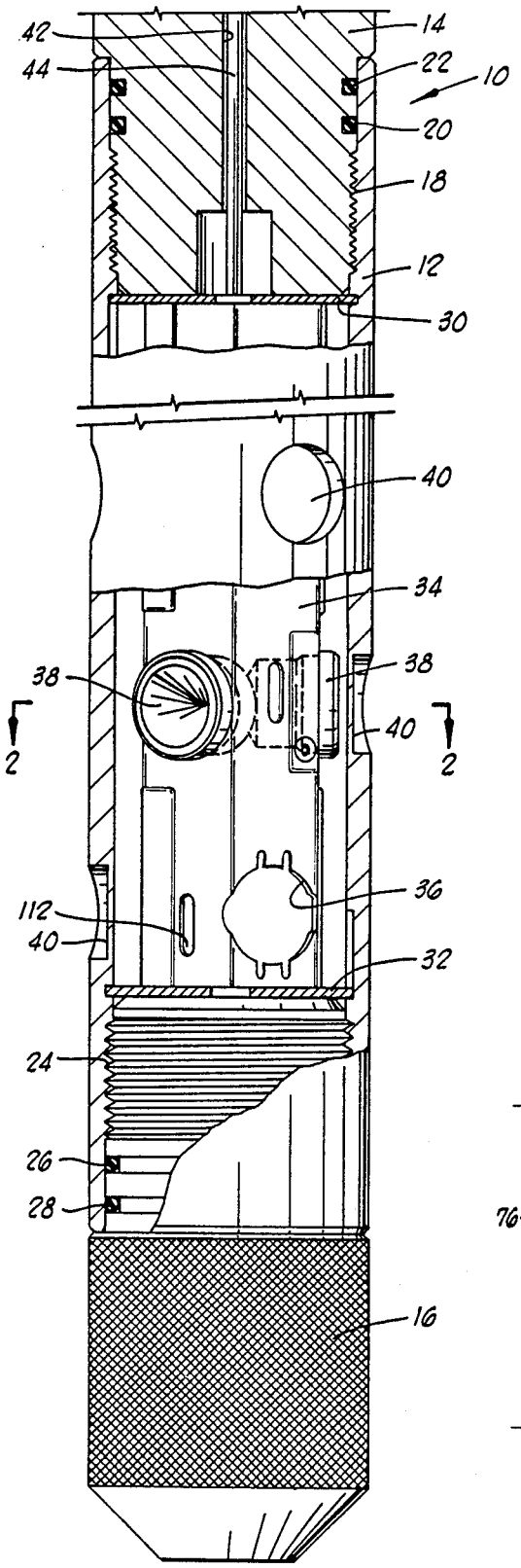
FIG. 1 is an elevation, partly section view of a perforating gun showing a carrier in place within the perforating gun, with a plurality of shaped charges in place within the carrier.

Referring now to the drawings, and particularly to FIG. 1, a perforating gun is thereshown and generally designated by the numeral 10. The perforating gun 10 includes an elongated cylindrical outer housing 12, the upper end of which is closed by a top plug 14 and the lower end of which is closed by a bottom plug 16.

Top plug 14 is threadedly connected to housing 12 at threaded connection 18 and a seal is provided therebetween by the O-rings 20 and 22. The bottom plug 16 is threadedly connected to housing 12 at the threaded connection 24 and a resilient seal is provided therebetween by O-rings 26 and 28.

In place within the housing 12 adjacent the lower end of top plug 14 and the upper end of bottom plug 16 are upper and lower carrier mounting plates 30 and 32, respectively.

Held in place between the upper and lower mounting plates 30 and 32 is an elongated charge carrier 34. The carrier illustrated in FIG. 1 is a generally hexagonal cross-section tubular carrier.

The carrier 34 has disposed through the wall thereof a plurality of openings 36 for receiving shaped charges 38 therein.

The carrier 34 is attached to the end plates 30 and 32 in such a manner as to specifically define its orientation about its longitudinal axis relative to the housing 12, so that each of the shaped charges 38 is located immediately adjacent a reduced thickness portion 40 of the housing 12 in a manner well known to those skilled in the art.

Disposed through a central opening 42 of top plug 14 is a firing means 44 which generally comprises a length of primacord and associated apparatus for firing the shaped charges 38 in response to an electrical signal directed down a wireline (not shown) from a surface location at the top of the oil well which is being perforated. As will be understood by those skilled in the art, the firing means 44 extends downward through the carrier 34 and is operatively connected to each of the shaped charges 38.

Figure 3:
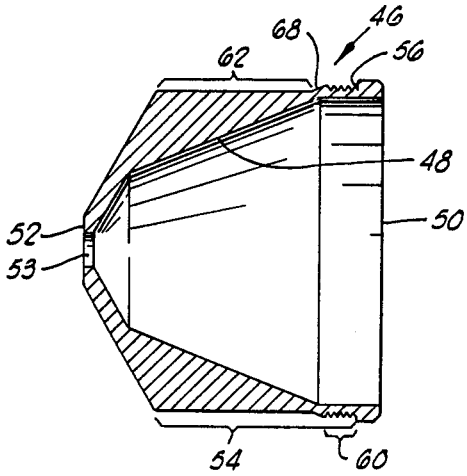
FIG. 3 is a cross-section view taken along the length of an outer case of one of the shaped charges shown in FIG. 2, this particular case being constructed for use only with the hexagonal cross-section carrier.
Figure 4:
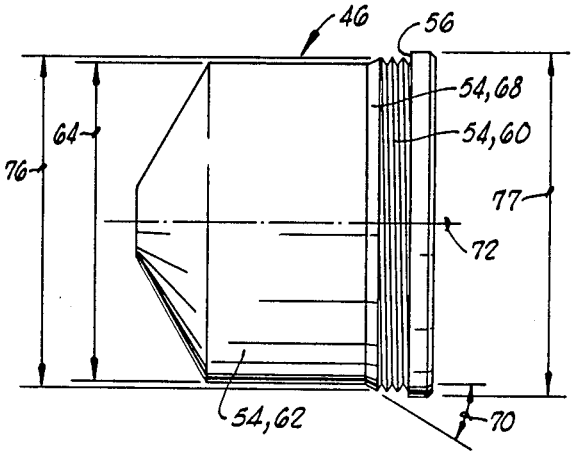
FIG. 4 is a side elevation view of the outer case of the shaped charge shown in FIG. 3.

Each of the shaped charges 38 constructed in accordance with the present invention has an outer case 46 as is best illustrated in FIGS. 3 and 4. FIG. 3 is a cross-sectional view solely of the outer case of the shaped charge 38, and as will be understood by those skilled in the art, the interior 48 of the case 46 will contain appropriate explosives and liners.

The case 46 has a forward end 50 and a rearward end 52. An opening 53 is disposed through rearward end 52 to permit the connection of the firing means 44 to the explosvie contained in case 46. Case 46 includes a generally cylindrically shaped outer surface 54 and a rearwardly facing first shoulder 56 extending radially outward from outer surface 54.

Figure 2:
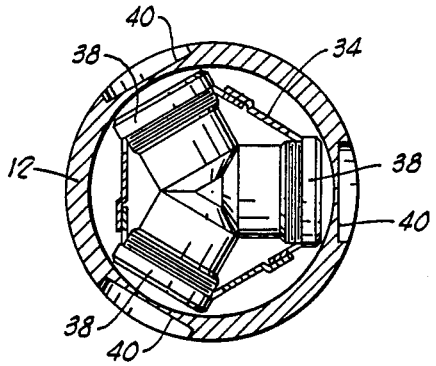
FIG. 2 is a section view taken along line 2—2 of FIG. 1 showing a layer of three 120° circumferentially spaced shaped charges in place within the hexagonal cross-section carrier of FIG. 1.
Figure 6:
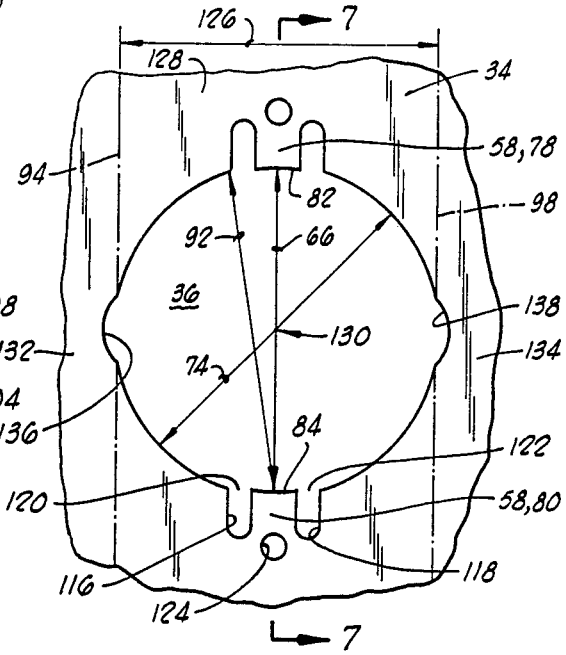
FIG. 6 is a detail view of one of the openings in the hexagonal cross-section tubular carrier of FIG. 5.

As is best seen in FIG. 6, each of the openings 36 disposed through the wall of carrier 34 is generally circular in shape and as illustrated in FIGS. 1 and 2 is large enough to receive the outer surface 54 of the case 46 therethrough.

The carrier 34 also includes resilient tab means 58 corresponding to each opening 36, which tab means extend into the opening 38 for frictionally engaging at least a first portion 60 of outer surface 54 of the case 46 and for thereby holding the shaped charge 38 in place relative to the carrier 34 with the first shoulder 56 of shaped charge 38 abutting the carrier 34 as best illustrated in FIGS. 1 and 2.

Preferably, the first portion 60 of cylindrical outer surface 54 is a grooved first portion 60 having a plurality of longitudinally spaced circumscribing grooves as best seen in FIG. 4. Although the grooves of first portion 60 of outer surface 54 may be formed in any number of ways, a preferable manner of forming the grooves is by machining a spiral thread-like surface on first portion 60 as best illustrated in FIG. 4.

The tab means 58 of carrier 34 engages the grooves of grooved first portion 60 of outer surface 54 of case 46 when the shaped charge 38 is in place with the shoulder 56 abutting the carrier 34.

The outer surface 54 of case 46 further includes a reduced diameter portion 62 located rearward of the grooved first portion 60. The reduced diameter portion 62 has an outside diameter 64 less than an internal diameter 66 (see FIG. 6) of opening 36 of carrier 34 at the tab means 58, so that the reduced diameter portion 62 of the outer surface 54 of the case 46 may freely pass through the opening 36.

The cylindrical outer surface 54 of case 46 further includes a tapered portion 68 located between the reduced diameter portion 62 and the grooved first portion 60. Preferably, the tapered portion 68 slopes at an angle 70 of about 15° from a central axis 72 of the case 46.

The generally circular opening 36 has an inside diameter 74 (see FIG. 6) which is greater than the outside diameter 64 (see FIG. 4) of reduced diameter portion 62 and which is also greater than the outside diameter 76 (see FIG. 4) of grooved first portion 60 of outer surface 54.

The first shoulder 56 of case 46 is annular in shape and has an outside diameter 77 (see FIG. 4) greater than the inside diameter 74 (see FIG. 6) of opening 36 so that the shoulder 56 cannot fit through the opening 36.

As illustrated in FIG. 6, the resilient tab means 58 of the carrier 34 preferably includes two diametrically opposed tabs 78 and 80 located on opposite sides of opening 36, said tabs 78 and 80 extending into the opening 36 toward each other. Preferably, the opposed tabs 78 and 80 lie along a line substantially parallel to a longitudinal axis of carrier 34.

The internal diameter 66 of the opening 36 at the tab means 58, which may also be defined as the diametrical distance between radially innermost ends 82 and 84 of tabs 78 and 80, is less than the inside diameter 74 of the generally circular portion of opening 36, and is also less than the outside diameter 76 of first portion 60 of cylindrical outer surface 54 of case 46.

Thus, the dimensional relationships just defined for the case 46 and the opening 36 provide a carrier 34 and outer case 46 of shaped charge 38 which are so arranged and constructed that when the cylindrical outer surface 54 of case 46 is inserted in a rearward direction through the opening 36 of carrier 34 until the shoulder 56 abuts the carrier 34, the tabs 78 and 80 of resilient tab means 58 frictionally engage the first portion 60 of outer surface 54 and are deflected rearwardly from an initial position of the tabs. The reduced diameter surface 62 is freely received between tabs 78 and 80. The tapered surface 68 engages the tabs 78 and 80 and deflects them before they engage the first portion 60 of outer surface 54.

Figure 7:
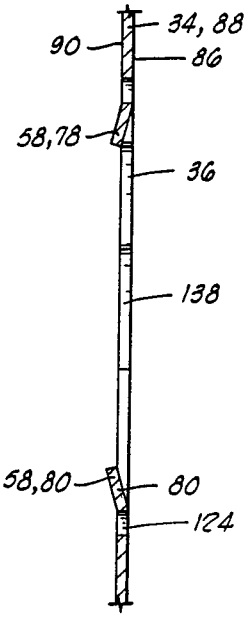
FIG. 7 is a sectional view taken along line 7—7 of FIG. 6, showing the manner in which the tabs are initially bent out of the plane of the wall of the carrier.
Figure 13:
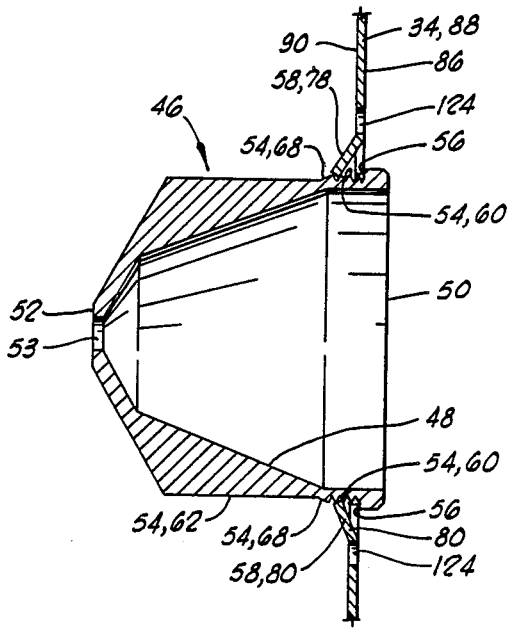
FIG. 13 is a view similar to FIG. 7, but showing a shaped charge in place within the carrier.

This is best understood by viewing FIGS. 7 and 13. FIG. 7 is a sectional view taken along line 7—7 of FIG. 6 and illustrates the initial position of tabs 78 and 80 of resilient tab means 58 prior to insertion of the shaped charge 38 in the opening 36. In FIG. 7, the numeral 86 designates the outer surface of the wall 88 of carrier 34, and the numeral 90 designates the inner surface of wall 88. As shown in FIG. 7, the tabs 78 and 80 are preferably initially deformed to a slightly rearward position out of the plane of wall 88 so as to promote the ease of insertion of the shaped charge 36 therebetween.

The tabs 78 and 80 are so dimensioned and constructed that when they are deflected from their initial position shown in FIG. 7 to the position shown in FIG. 13, they are resiliently deformed, and while they are so deflected the tabs 78 and 80 continuously exert opposed lateral forces against the threaded first portion 60 of outer surface 54 of case 46 so as to tightly hold the case 46 in place relative to the carrier 34. In the illustrated embodiment, this resilient deformation is partially elastic. Although the tabs are to some extent permanently deformed during the insertion of the case 46, the tabs still press against the sides of case 46.

The appropriate dimensions and shape of the tabs will, of course, depend upon the particular material utilized, the number of tabs utilized, the shape and size of the outer surface of the shaped charge, and the desired insertion force.

Preferably, the tab means 58 is constructed so that the shaped charges 38 may be inserted in the openings 36 by manually applied pressure against the outer forward end of the shaped charge 38. The tab means 58 is preferably constructed to provide the maximum frictional holding force against the case 46, while still being flexible enough that the case 46 may be inserted manually.

As illustrated in FIG. 6, the preferred embodiment of the present invention utilizes a resilient tab means 58 having first and second diametrically opposed tabs 78 and 80. The present invention is not, however, limited to such an embodiment, and it is possible to utilize the principles of the present invention with a tab means having one, two, three or more tabs circumferentially spaced about the opening 36.

The tab means 58 illustrated in FIG. 6 is designed so that if either one of the tabs 78 or 80 is damaged, i.e., bent out of shape so that it cannot engage the case 46, the remaining functional tab 78 or 80 will still hold the case 46 firmly in place relative to the carrier 34. This feature is accomplished as follows. A distance 92 (see FIG. 6) between the radially innermost end 84 of tab 80 and the inner edge of generally circular opening 36 immediately adjacent the other tab 78 is sufficiently less than the outside diameter 76 (see FIG. 4) of grooved first portion 60 of outer surface 54 of case 46 so that if either of the tabs 78 or 80 is deformed so that it cannot engage the case 46, the other of the tabs 78 or 80 will still frictionally engage the grooved first portion 60 of cylindrical outer surface 54 of case 46 to hold the shaped charge 38 in place relative to carrier 34 with the shoulder 56 of shaped charge 38 abutting the carrier 34.

Figure 5:
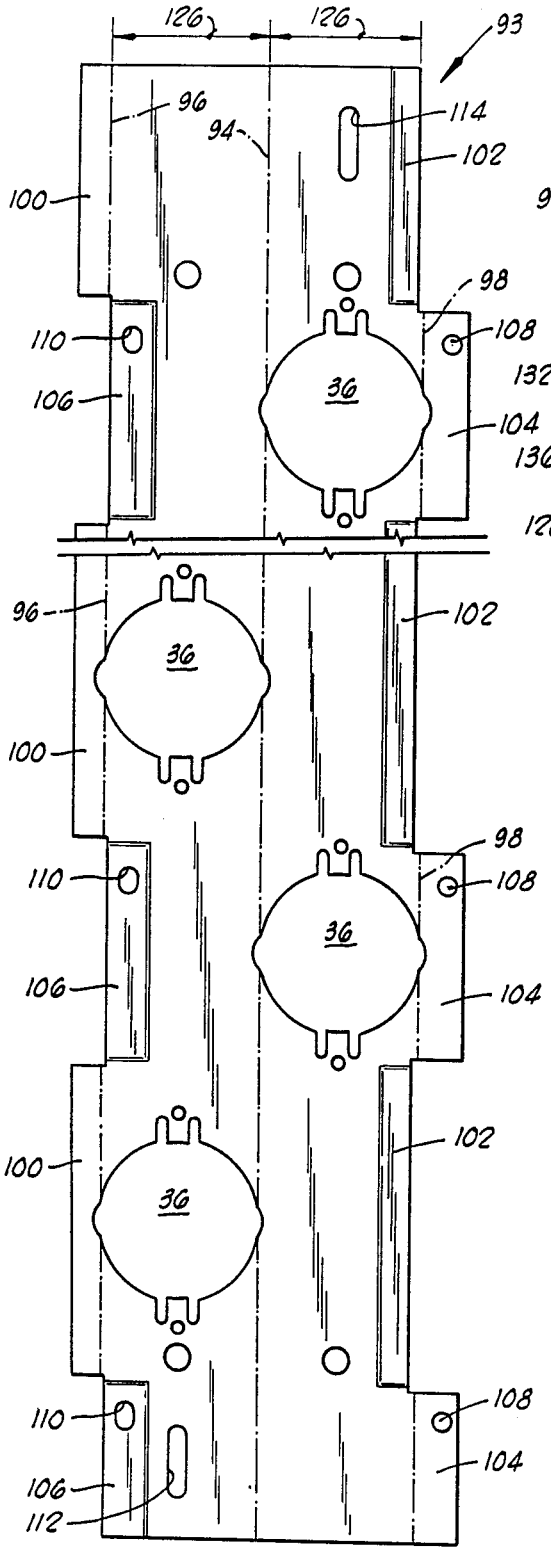
FIG. 5 is an elevation view of one of three identical stamped panels, which when assembled provide a hexagonal cross-section tubular carrier like that illustrated in FIGS. 1 and 2.

The carrier 34 is preferably constructed from sheet metal, and in the embodiment disclosed in the present application for the hexagonal cross-section tubular carrier 34 as seen in FIGS. 1, 2, 5, 6 and 7, the tubular carrier is formed by joining three sheet metal sections. One of those sheet metal sections is shown in FIG. 5 and designated by the numeral 93. The sheet metal section 93 is a single integral piece of metal formed from a metal sheet by appropriate stamping and cutting operations.

A central imaginary line 94 represents the line along which the sheet metal section 93 will be creased to form one of the six points of the hexagonal cross section of the carrier 34. Similarly, imaginary lines 96 and 98 represent lines where the sheet metal parts will be creased to form the points of the hexagonal cross section immediately adjacent to that formed at crease line 94.

The sheet metal section 93 is formed with a plurality of leftward extending tabs 100 on its left side which are circumferentially opposed to raised pockets 102 along its right side. When the section 93 is assembled with two identical sections, the tabs 100 will fit within pockets 102 of the adjacent section. Also, the section 93 includes a series of rightward extending tabs 104 and a corresponding series of raised pockets 106 on its left side. Again, when section 93 is assembled with two identical sections, the rightward extending tabs 104 will fit within the pockets 106 of the adjacent section.

Each of the tabs 104 includes a rivet hole 108, and each of the raised pockets 106 includes a rivet receiving hole 110. When the tabs 104 are received in the pockets 106 of the adjacent similarly designed sections, they are rigidly fixed together by rivets (not shown) disposed through the holes 108 and 110 which will be registry.

The sheet metal section 93 includes elongated slots such as 112 and 114 which are utilized in forming the connection between the carrier 34 and the end plates 30 and 32 previously described with regard to FIG. 1. That end plate connection is not material to the present invention and the details thereof need not be described herein.

As is best seen with reference to the lower end of FIG. 6, the tabs 78 and 80 of the tab means 58 are formed by creating two spaced slots, such as 116 and 118, on either side of tab 80, said slots having open ends 120 and 122 joining the substantially circular opening 36 of carrier 34.

Also, as shown in FIG. 6, a hole 124 may be formed through the wall of carrier 34 near the root of tab 80 to increase the flexibility of tab 80.

When utilizing the substantially hexagonal cross-section carrier 34, it will be appreciated that the hexagonal tubular carrier 34 defines six planar outer surfaces of substantially equal width 126.

In FIG. 6, one of these six planar outer surfaces is designated by the numeral 128.

The generally circular opening 36, shown in FIG. 6, has its central axis 130 oriented perpendicular to the planar outer surface 128 of carrier 34. This central axis 130 is substantially centered across the width 126 of the planar outer surface 128.

As is apparent in viewing FIG. 6, the inside diameter 74 of generally circular opening 36 and the outside diameter 76 (see FIG. 4) of grooved first portion 60 of cylindrical outer surface 54 of case 46 are each greater than the width 126 of the planar outer surface 128 of carrier 34. Thus, the generally circular opening 36 extends partly into each of the planar outer surfaces 132 and 134 of the carrier 34 immediately adjacent to the planar outer surface 128.

When the sheet metal sections such as 93 seen in FIG. 5 of carrier 34 are initially formed, and are still laid out flat, the opening 36 has egg-shaped extensions 136 and 138 which extend over the imaginary lines 94 and 98 into the adjacent planar outer surfaces 132 and 134.

The egg-shaped extensions 136 and 138 are shaped such that when three of the sheet metal sections like 93 are creased along the lines 94, 96 and 98 and then assembled in the fashion illustrated in FIG. 2, the opening 36 with its egg-shaped extensions 136 and 138, when viewed along the central axis 130 of opening 36 presents a substantially circular opening for receipt of the cylindrical outer surface 54 of case 46.

ALTERNATIVE EMBODIMENT OF FIGS. 8–12

Figure 8:
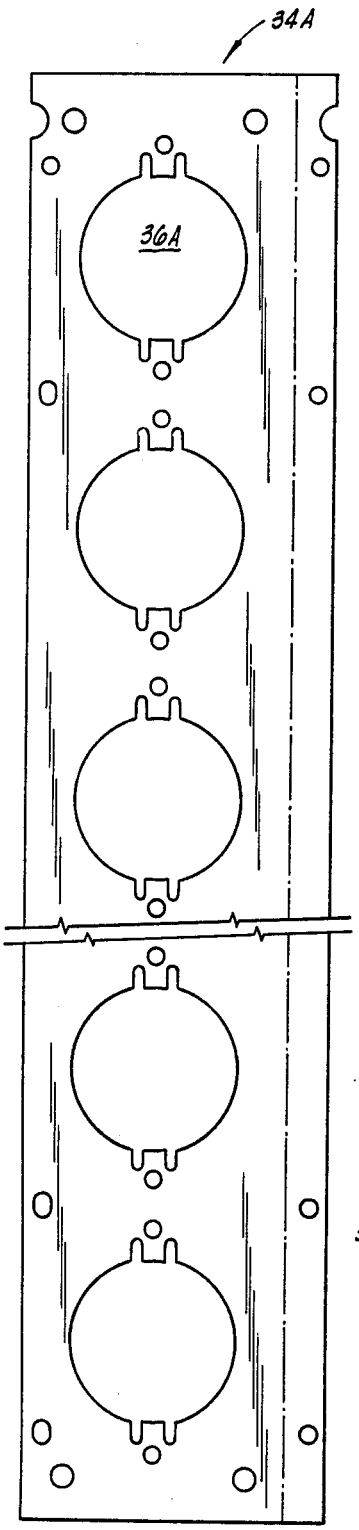
FIG. 8 is an elevation view of one of three stamped sheetmetal sections, which when assembled provided a triangular cross-section carrier like that illustrated in FIG. 12.
Figure 9:
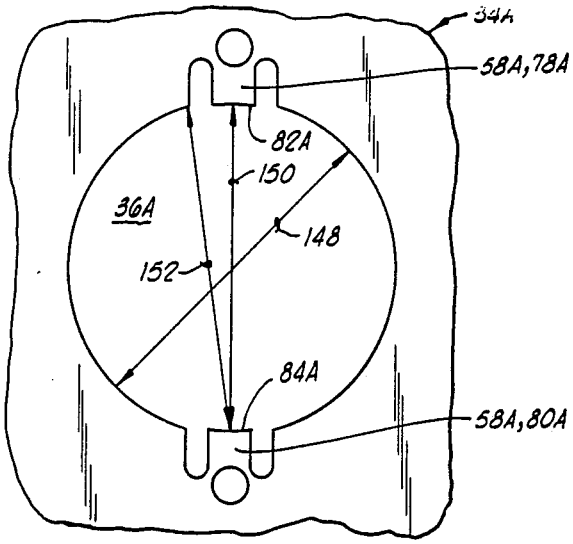
FIG. 9 is an enlarged detail view of one of the openings of the triangular cross-section carrier of FIGS. 8 and 12.
Figure 10:
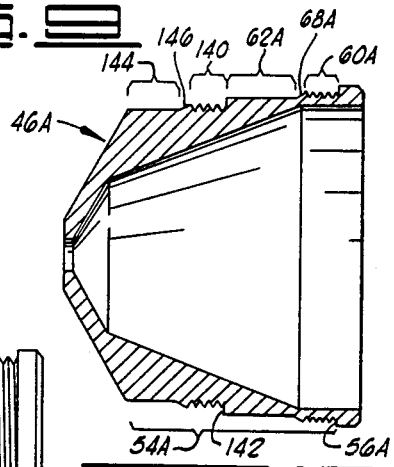
FIG. 10 is a cross-section view similar to FIG. 3 of a modified embodiment of the outer case of a shaped charge which is constructed so that it may be utilized in either a hexagonal or a triangular cross-section tubular carrier.
Figure 11:
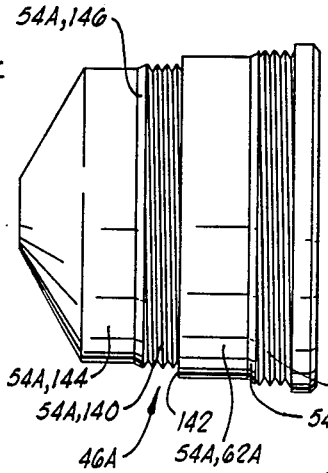
FIG. 11 is a side elevation view of the charge case of FIG. 10.
Figure 12:
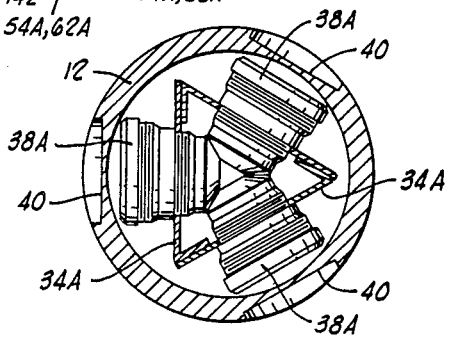
FIG. 12 is a view similar to FIG. 2, illustrating the manner in which the alternative charge case of FIGS. 10 and 11 is assembled with a triangular cross-section tubular carrier.

Referring now to FIGS. 10 and 11, views are thereshown very similar to FIGS. 3 and 4 of an alternative embodiment for a shaped charge case which is designed to be utilized either with the hexagonal cross-section tubular carrier 34 previously described with regard to FIGS. 1, 2, 5 and 6 or a triangular cross-section tubular carrier 34A seen in FIGS. 8, 9 and 12.

For purposes of the following description of this alternative embodiment, those features identical to or closely analogous to features of the hexagonal cross-section carrier 34 will be designated by the identical numeral with the addition of a suffix A.

A modified case 46A seen in FIGS. 10 and 11 has a cylindrical outer surface 54A, a radially outward extending shoulder 56A, a grooved first portion 60A, a first reduced diameter portion 62A, and a tapered portion 68A joining the grooved first portion 60A and the first reduced diameter portion 62A.

The case 46A can be utilized in place of the case 46 previously described and assembled in a hexagonal cross-section tubular carrier 34 just as illustrated in FIG. 2 for the previously described cases 46.

The modified case 46A includes a second grooved portion 140. The location of the second grooved portion 140 may be defined as being located on a side of first grooved portion 60A opposite from the first shoulder 56A. The second grooved portion 140 has an outside diameter less than an outside diameter of both the first grooved portion 60A and the reduced diameter portion 62A.

The modified case 46A further includes a second shoulder 142. The location of second shoulder 142 may be defined as being located between the first and second grooved portions 60A and 140 of outer surface 54A, and in the particular embodiment shown in FIGS. 10 and 11, second shoulder 142 joins second grooved surface 140 and reduced diameter portion 62A.

The modified case 46A further includes a second reduced diameter portion 144 having an outside diameter less than that of second grooved portion 140. The second reduced diameter portion 144 and the second grooved portion 140 are joined by a second tapered portion 146.

When the modified case 46A is utilized with a triangular cross-section tubular carrier 34A such as shown in FIG. 12, it is the second grooved portion 140 and the second shoulder 142 which interact with the tab means 58A to hold the case 46A in place within an opening 36A of the carrier 34A.

The relationships of the dimensions of opening 36A to the dimensions of the second grooved portion 140 and second reduced diameter portion 144 are similar to the relationships previously described with regard to the dimensions of the opening 36 in relation to the first grooved portion 60 and first reduced diameter portion 62.

With reference to FIG. 9, the generally circular opening 36A has an inside diameter 148 which is greater than the outside diameter of both the second grooved portion 140 and the second reduced diameter portion 144 of case 46A. The outside diameter of second shoulder 142, however, is greater than inside diameter 148 of opening 36A so that the second shoulder 142 cannot pass through opening 36A but instead abuts the wall of carrier 34A.

A diametrical distance 150 between radially innermost ends 82A and 84A of tabs 78A and 80A is less than the inside diameter 148 of opening 36A and is also less than the outside diameter of second grooved portion 140 of cylindrical outer surface 54A of the case 46A.

The distance 150 between tabs 78A and 80A is, however, greater than the outside diameter of second reduced diameter portion 144.

Thus, when case 46A is inserted in a rearward direction through the opening 36A, the second reduced diameter portion 144 freely passes between tabs 78A and 80A. As the inserting movement continues, the ends 82A and 84A of tabs 78A and 80A first engage the tapered portion 146 and then engage the second grooved portion 140 of outer surface 54A. The inserting movement stops when second shoulder 142 abuts the outer surface of carrier 34A. At that point, the ends 82A and 84A of tabs 78A and 80A will be in engagement with one of the grooves of second grooved portion 140 in a manner similar to that previously described with regard to FIG. 13 and with regard to the first embodiment of the invention.

Also, the opening 36A is similar to the opening 36 in that if either of the tabs 78A or 80A is damaged, the remaining tab will still firmly engage the second grooved portion 140. A distance 152 between radially innermost end 84A of tab 80A and the edge of generally circular opening 36A immediately adjacent the other tab 78A is less than the outside diameter of second grooved portion 140 of the cylindrical outer surface 54A so that the functional tab 80A will still frictionally engage the second grooved portion 140 to hold the case 46A of shaped charge 38A firmly in place relative to the carrier 34A with the shoulder 142 abutting carrier 34A.

The first and second grooved portions 60A and 140 of outer surface 54A of case 46A, and the first and second shoulders 56A and 142 thereof, are so dimensioned that for any given size of perforating gun the case 46A of shaped charge 38A may be received in either a hexagonal cross-sectional tubular carrier 34 or a triangular cross-sectional tubular carrier 34A in a pattern of three 120° circumferentially spaced charges 38 or 38A per horizontal plane, as seen in FIGS. 2 and 12. The first shoulder 56A abuts the carrier 34 when the hexagonal cross-sectional carrier is utilized. The second shoulder 142 abuts the carrier 34A when the triangular cross-sectional carrier is utilized.

FIGS. 2 and 12 represent identical sized perforating guns having identical outer housings 12, and the casings 46A have identical dimensions from their forward end to the second shoulder 142 as are present on the case 46 shown in FIGS. 2–4.

Thus, the single case 46A may be stocked for use in either the hexagonal or the triangular cross-section tubular carriers for use in any given size of perforating gun.

The choice of whether to use a triangular or hexagonal crosssectional tubular carrier depends upon the particular pattern of charges which is desired, as will be understood by those skilled in the art. If the hexagonal cross-section carrier is utilized, the three charges in immediately adjacent longitudinally spaced layers are rotated 60° about the longitudinal axis of the carrier. With the triangular cross-section carrier of FIG. 8 and 12, on the other hand, the shaped charges of adjacent layers are longitudinally aligned.

Thus, it is seen that the apparatus and methods of the present invention readily achieve the ends and advantages mentioned as well as those inherent therein. While certain preferred embodiments of the present invention have been illustrated for the purposes of this disclosure, numerous changes in the arrangement and construction of parts and steps may be made by those skilled in the art, which changes are embodied within the scope and spirit of the present invention as defined by the appended claims.

What is claimed is:

1. A shaped charge carrier assembly apparatus for use in a perforating gun, comprising:

at least one shaped charge including an outer case having an outer surface and a first shoulder extending radially outward from said outer surface; and a carrier having an opening therethrough large enough to receive said outer surface of said case, and having resilient tab means extending into said opening for frictionally engaging at least a first portion of said outer surface of said case and for thereby holding said shaped charge in place relative to said carrier with said shoulder of said shaped charged abutting said carrier;

wherein said first portion of said outer surface of said case is a grooved portion having a plurality of longitudinally spaced circumscribing grooves; and said tab means of said carrier engages one of said grooves of said case when said shaped charge is in place with said shoulder of said shaped charge abutting said carrier.

2. A shaped charge carrier assembly apparatus for use in a perforating gun, comprising:

at least one shaped charge including an outer case having an outer surface and a first shoulder extending radially outward from said outer surface; and a carrier having an opening therethrough large enough to receive said outer surface of said case, and having resilient tab means extending into said opening for frictionally engaging at least a first portion of said outer surface of said case, and for holding said shaped charge in place relative to said carrier with said shoulder of said shaped charge abutting said carrier;

wherein said first portion of said outer surface of said case is a grooved portion having a plurality of longitudinally spaced circumscribing grooves;

said tab means of said carrier engages one of said grooves of said case when said shaped charge is in place with said shoulder of said shaped charge abutting said carrier;

said outer surface of said case is generally cylindrical in shape and further includes a reduced diameter portion located rearward of said grooved portion, said reduced diameter portion having a diameter less than an internal diameter of said opening of said carrier at said tab means so that said reduced diameter portion of said outer surface of said case may freely pass through said opening; and said cylindrical outer surface of said case further includes a tapered portion between said reduced diameter portion and said grooved portion.

3. The apparatus of claim 1, wherein:

said outer surface of said case is generally cylindrical in shape and further includes a reduced diameter portion located rearward of said grooved portion, said reduced diameter portion having a diameter less than an internal diameter of said opening of said carrier at said tab means so that said reduced diameter portion of said outer surface of said case may freely pass through said opening.

4. The apparatus of claim 3, wherein:

said cylindrical outer surface of said case further includes a tapered portion between said reduced diameter portion and said grooved portion.

5. The apparatus of claim 1, wherein:

said opening through said carrier is generally circular in shape, said outer surface of said case is generally cylindrical in shape, and said opening has an inside diameter greater than an outside diameter of said cylindrical outer surface of said case.

6. The apparatus of claim 5, wherein:

said shoulder of said case of said shaped charge is annular and has an outside diameter greater than said inside diameter of said opening of said carrier.

7. The apparatus of claim 5, wherein:

said resilient tab means of said carrier includes two diametrically opposed tabs located on opposite sides of said opening, said tabs being attached to said carrier along the circumference of said opening and said tabs extending into said opening toward each other.

8. The apparatus of claim 7, wherein:

a diametrical distance between radially innermost ends of said two tabs is less than said inside diameter of said opening and is less than an outside diameter of said first portion of said cylindrical outer surface of said case.

9. The apparatus of claim 8, wherein:

said carrier and said outer case of said shaped charge are so arranged and constructed that when said cylindrical outer surface of said case is inserted in a rearward direction through said opening of said carrier until said shoulder abuts said carrier, said two tabs are deflected rearwardly from an initial position of said tabs; and said tabs are so dimensioned and constructed that they are resiliently deformed when they are so deflected, and while they are so deflected said tabs continuously exert opposed lateral forces against said first portion of said cylindrical outer surface of said case.

10. A shaped charge carrier assembly apparatus for use in a perforating gun, comprising:

at least one shaped charge including an outer case having an outer surface and a first shoulder extending radially outward from said outer surface; and a carrier having an opening therethrough large enough to receive said outer surface of said case, and having resilient tab means extending into said opening for frictionally engaging at least a first portion of said outer surface of said case and for thereby holding said shaped charge in place relative to said carrier with said shoulder of said shaped charge abutting said carrier;

wherein said opening through said carrier is generally circular in shape, said outer surface of said case is generally cylindrical in shape, and said opening has an inside diameter greater than an outside diameter of said cylindrical outer surface of said case;

said resilient tab means of said carrier includes two diametrically opposed tabs located on opposite sides of said opening, said tabs extending into said opening toward each other;

a diametrical distance between radially innermost ends of said two tabs is less than said inside diameter of said first portion of said cylindrical outer surface of said case;

said first portion of said cylindrical outer surface of said case is a grooved portion having a plurality of longtiudinally spaced circumscribing grooves; and said end of each of said tabs engages one of said grooves when said shaped charge is in place with said shoulder of said shaped charge abutting said carrier.

11. The apparatus of claim 8, wherein:

a distance between said radially innermost end of each one of said tabs and an edge of said generally circular opening of said carrier immediately adjacent the other of said tabs is sufficiently less than an outside diameter of said first portion of said cylindrical outer surface of said case so that if either of said tabs is deformed so that engagement with said case cannot be made, the other of said tabs will still frictionally engage said first portion of said cylindrical outer surface of said case to hold said shaped charge in place relative to said carrier with said shoulder of said shaped charge abutting said carrier.

12. A shaped charge carrier assembly apparatus for use in a perforating gun, comprising:

at least one shaped charge including an outer case having an outer surface and a first shoulder extending radially outward from said outer surface; and a carrier having an opening therethrough large enough to receive said outer surface of said case, and having resilient tab means extending into said opening for frictionally engaging at least a first portion of said outer surface of said case and for thereby holding said shaped charge in place relative to said carrier with said shoulder of said shaped charge abutting said carrier;

wherein said carrier is constructed from sheet metal; and said tab means includes a tab formed by creating two spaced slots, one on either side of said tab, said slots each having an open end joining said opening of said carrier.

13. The apparatus of claim 1, wherein:

said carrier is further characterized as a tubular carrier having a generally hexagonal cross-sectional shape defining six planar outer surfaces of substantially equal width.

14. The apparatus of claim 13, wherein:

said opening through said carrier is generally circular in shape and has a central axis oriented substantially perpendicular to one of said six planar outer surfaces of said carrier, said central axis of said generally circular opening being substantially centered across the width of said one planar outer surface of said carrier;

said outer surface of said case is generally cylindrical in shape; and an inside diameter of said generally circular opening and an outside diameter of said first portion of said cylindrical outer surface of said case are each greater than said width of said one planar outer surface of said carrier, so that said generally circular opening extends partly into each of the planar outer surfaces of the carrier immediately adjacent said one planar outer surface.

15. A shaped charge carrier assembly apparatus for use in a perforating gun, comprising:

at least one shaped charge including an outer case having an outer surface and a first shoulder extending radially outward from said outer surface; and a carrier having an opening therethrough large enough to receive said outer surface of said case, and having resilient tab means extending into said opening for frictionally engaging at least a first portion of said outer surface of said case and for thereby holding said shaped charge in place relative to said carrier with said shoulder of said shaped charge abutting said carrier;

wherein said outer surface of said case is generally cylindrical in shape;

said outer surface of said case includes a second portion located on a side of said first portion opposite from said first shoulder, said second portion having a diameter less than a diameter of said first portion;

said case includes a second shoulder located between said first and second portions of said outer surface; and said first and second portions of said outer surface of said case and said first and second shoulders are so dimensioned that for any given size of perforating gun, said shaped charge may be received in either one of a hexagonal and a triangular cross-sectional tubular carrier in a pattern of three 120° circumferentially spaced charges per horizontal plane, said first shoulder abutting the carrier if a hexagonal carrier is utilized, and said second shoulder abutting the carrier if a triangular carrier is utilized.

16. A perforating gun apparatus, comprising:

an elongated housing adapted to be lowered into a well;

an elongated charge carrier disposed in said housing and having:

a plurality of longitudinally spaced generally circular shaped openings disposed through a wall of said carrier; and a pair of diametrically opposed resilient tabs located on opposite sides of each of said openings, said tabs of each pair of tabs extending toward each other;

a plurality of shaped charges, one of said shaped charges being received in each one of said openings of said carrier and held by said carrier in a proper orientation to perforate a reduced thickness portion of said housing upon detonation of said shaped charges;

each of said shaped charges including an outer case having a cylindrical outer surface and a shoulder extending radially outward from said cylindrical outer surface, said cylindrical outer surface having a maximum outside diameter less than an inside diameter of the carrier opening within which the shaped charge is received so that said cylindrical outer surface of said case may be inserted through said opening until said shoulder of said case abuts an outer surface of said wall of said carrier;

wherein a diametrical distance between the tabs of each pair of tabs is less than said inside diameter of said carrier opening and is less than an outside diameter of a first portion of said cylindrical outer surface of said case so that said tabs frictionally engage said first portion of said cylindrical outer surface of said case to hold said shaped charge in place relative to said carrier and said housing with said shoulder of said case of said shaped charge abutting said carrier;

means for detonating said shaped charges wherein said cylindrical outer surface of said case of each of said shaped charges includes a grooved portion having a plurality of longitudinally spaced circumscribing grooves; and said resilient tabs of said carrier engage the grooves of said case when said shaped charge is in place with its shoulder abutting said carrier.

17. The apparatus of claim 16, wherein:

said cylindrical outer surface of said case of each of said shaped charges further includes a reduced diameter portion located rearward of said grooved portion, said reduced diameter portion having a diameter less than a distance between the opposed tabs of each pair of tabs so that said reduced diameter portion of said outer surface of said case may freely pass between said tabs; and said cylindrical outer surface of said case further includes a taperd portion between said reduced diameter portion and said grooved portion.

* * * * *